US005393286A

United States Patent [19]

Cheng

[11] Patent Number: 5,393,286

[45] Date of Patent: Feb. 28, 1995

[54] STRUCTURE OF EXERCISING MACHINE

[76] Inventor: Wen-Liang Cheng, No. 22-35, Chi Tzu Tou, Kuan Shih Village, Shui Shang County, Chia Yi, Taiwan, Prov. of China

[21] Appl. No.: 255,719

[22] Filed: Jun. 7, 1994

[51] Int. Cl.[6] ..... A63B 21/04

[52] U.S. Cl. ..... 482/130; 482/138; 482/133

[58] Field of Search ..... 482/130, 138, 133, 135, 482/136, 121, 123, 129

[56] References Cited

U.S. PATENT DOCUMENTS

| | | | |
|---|---|---|---|
| Re. 34,577 | 4/1994 | Habing et al. | 482/136 |
| 4,240,627 | 12/1980 | Brentham | 482/138 |
| 4,407,495 | 10/1983 | Wilson | 482/138 |
| 4,840,373 | 6/1989 | Maag | 482/136 |
| 4,949,951 | 8/1990 | Deola | 482/138 |
| 5,120,289 | 6/1992 | Yu | 482/136 |
| 5,215,511 | 6/1993 | Cheng | 482/121 |
| 5,290,214 | 3/1994 | Chen | 482/136 |

*Primary Examiner*—Richard J. Apley
*Assistant Examiner*—Lynne A. Reichard
*Attorney, Agent, or Firm*—Beveridge, DeGrandi, Weilacher & Young

[57] ABSTRACT

An exercising machine including a base frame having a seat at the top, a scissor grip unit bilaterally pivotally connected to the base frame for exercising the hands through a scissor's action, a leg exercising unit coupled to the base frame at the front for exercising the legs, a back rest pivotally connected to the base frame at the back, a first pair of springy members bilaterally connected between the scissor grip unit and the base frame to produce a resisting force against the scissor's action of the scissor grip unit, and a second springy members bilaterally connected between the base frame and the back rest to give a resisting force against the backward movement of the back rest.

2 Claims, 5 Drawing Sheets

FIG.3-A

STRUCTURE OF EXERCISING MACHINE

BACKGROUND OF THE INVENTION

The present invention relates to an exercising machine which includes a scissor grip unit for exercising the hands through a scissor's action, a leg exercising unit for exercising the legs, and a back rest for exercising the trunk.

Various exercising machines have been disclosed for exercising different parts of the body, and have appeared on the market. Some exercising machines are designed for a specific purpose while some others are designed for multiple purposes. When one wishes to exercise different parts of the body, one may have to prepare various single-purpose exercising machines or a multipurpose exercising machine. However, it is not economic to prepare several single-purpose exercising machines for exercising different parts of the body. If to install a multipurpose exercising machines, some functions may be not desired.

SUMMARY OF THE INVENTION

The present invention provides an exercising machine which has functions for exercising the hands, the legs, and the trunk. According to the present invention, the exercising machine comprises a base frame, a scissor grip unit bilaterally pivotally connected to the base frame for exercising the hands through a scissor's action, a leg exercising unit coupled to the base frame at the front for exercising the legs, a back rest pivotally connected to the base frame at the back, a first pair of springy members bilaterally connected between the scissor grip unit and the base frame to produce a resisting force against the scissor's action of the scissor grip unit, and a second springy members bilaterally connected between the base frame and the back rest to give a resisting force against the backward movement of the back rest.

According to another aspect of the present invention, the base frame has a pair of first upright rods bilaterally disposed near the rear end and a pair of second upright rods bilaterally disposed near the front end, the scissor grip unit has a pair of first coupling rods and a pair of second coupling rods for connection to the first upright rods or the second upright rods by the first pair of springy members. By connecting the first pair of springy members between the first upright rods and the first coupling rods, a resisting force is produced when the scissor grip unit is turned outwards. By connecting the first pair of springy members between the second upright rods and the second coupling rods, a resisting force is produced when the scissor grip unit is turned inwards.

BRIEF DESCRIPTION OF THE DRAWINGS

FIG. 3A is a side view of the leg exercising unit of the exercising machine shown in FIG. 1;

DETAILED DESCRIPTION OF THE PREFERRED EMBODIMENT

Figure 1:
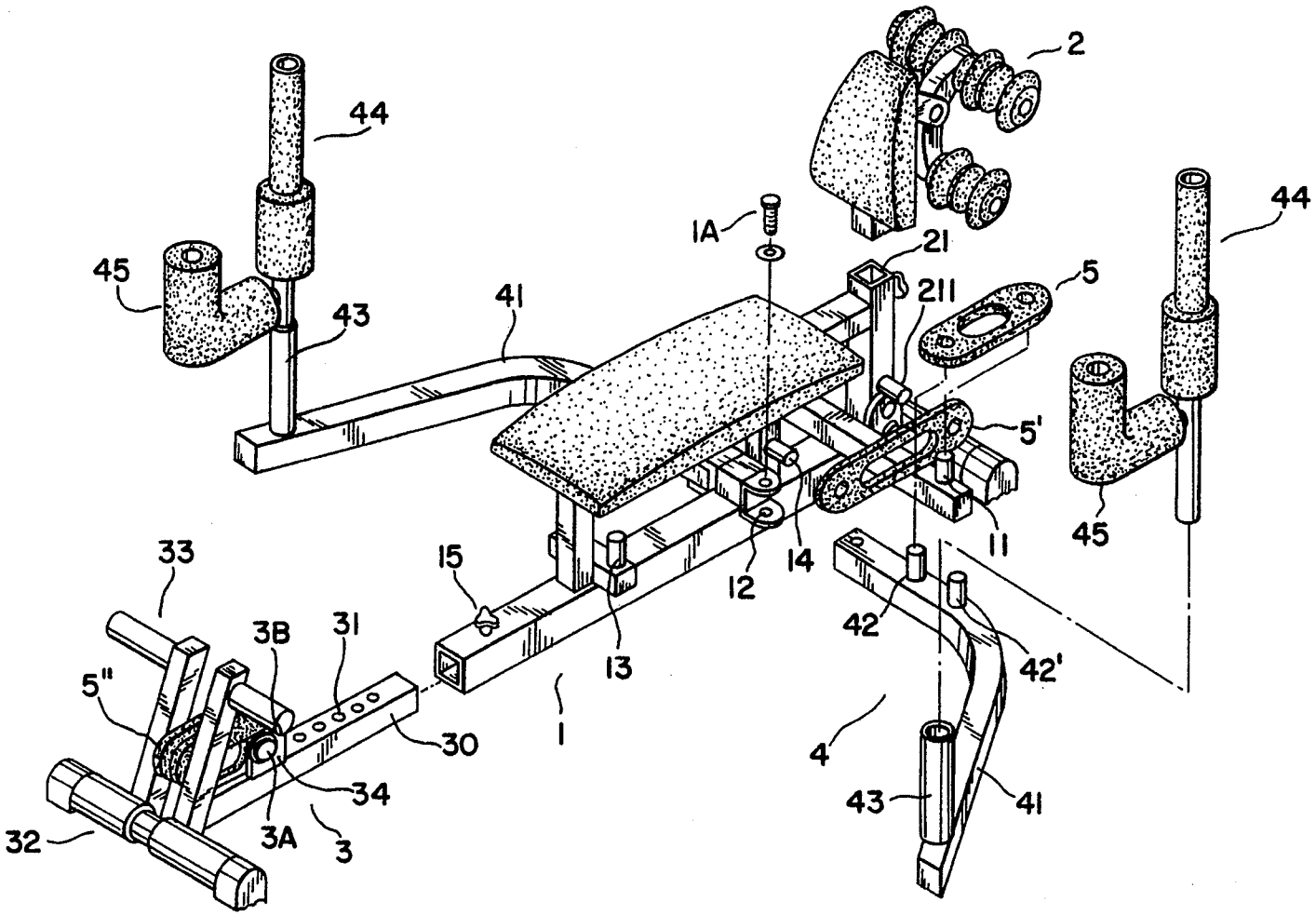
FIG. 1 is an exploded view of an exercising machine according to the present invention.
Figure 2:
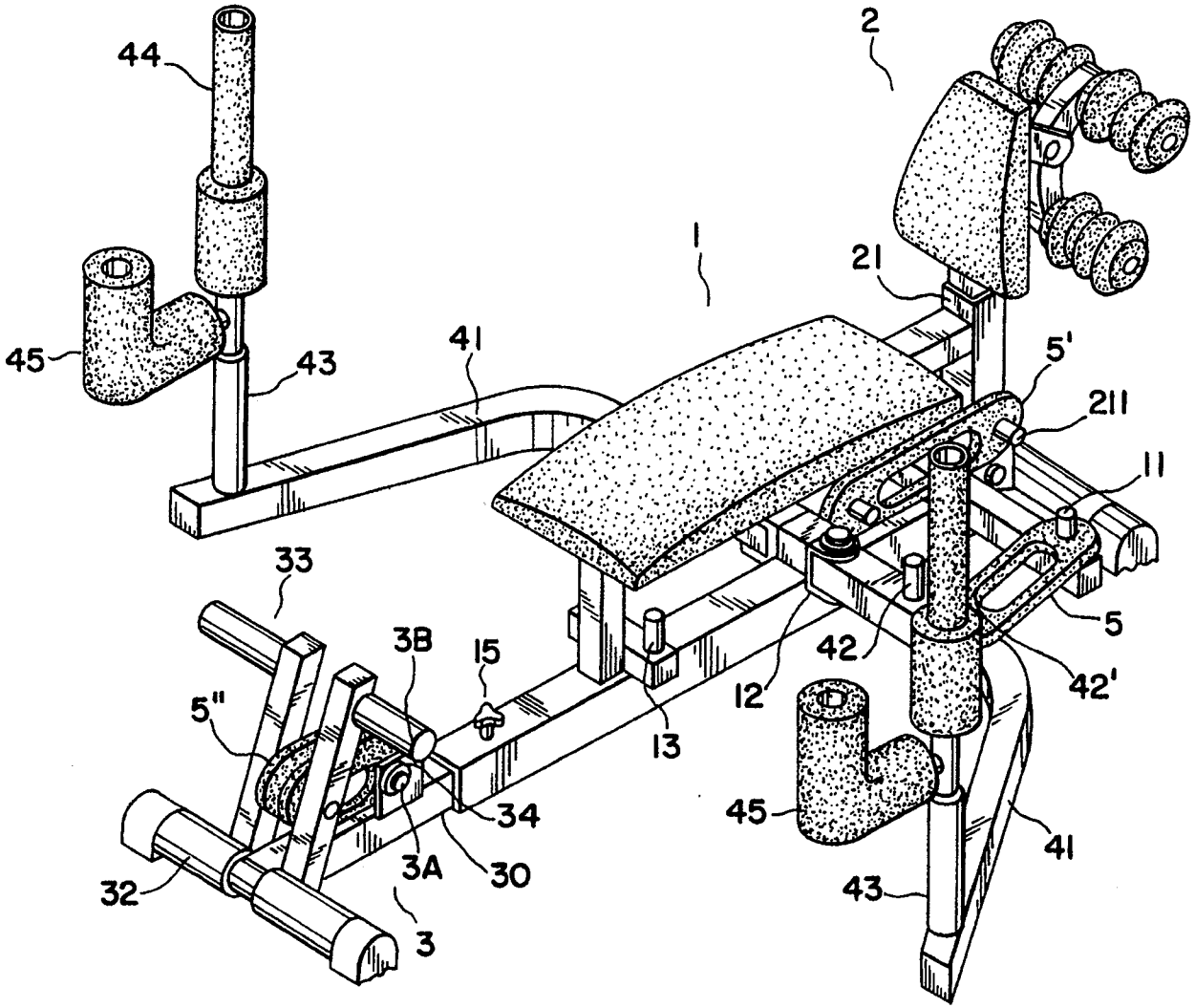
FIG. 2 is an elevational view of the exercising machine shown in FIG. 1.

Referring to FIGS. 1 and 2, an exercising machine according to the present invention is generally comprised of a base frame 1 providing a seat for the player, a back rest 2 mounted on the base frame 1 at one end, a leg exercising unit 3 mounted on the base frame 1 at an opposite end, and a scissor grip unit 4 mounted on the base frame 1 in the middle between the back rest 2 and the leg exercising unit 3. The base frame 1 comprises a bracket 12 transversely disposed at the bottom, a pair of first upright rods 11 bilaterally disposed between the bracket 12 and the back rest 2, a pair of second upright rods 13 bilaterally between the bracket 12 and the leg exercising unit 3, and a pair of horizontal rods 14 disposed at two opposite sides adjacent to the bracket 12. The scissor grip unit 4 comprises two pivoted lever arms 41 symmetrically pivotally connected to the bracket 12 at two opposite sides by a respective pivot bolt 1A. Each pivoted lever arm 41 comprises a socket 43 upstanding from the free end thereof to hold a respective handle 44, and two spaced coupling rods, namely, the first coupling rod 42′ and the second coupling rod 42′ spaced in the middle at the top. The handle 44 has a soft hand rest 45. Two first springy members 5 are provided for connection between the first coupling rod 42′ of each pivoted lever arm 41 and the first upright rods 11. Alternatively, the spring members 5 may be connected between the second coupling rod 42 of each pivoted lever arm 41 and the second upright rods 12.

Figure 4:
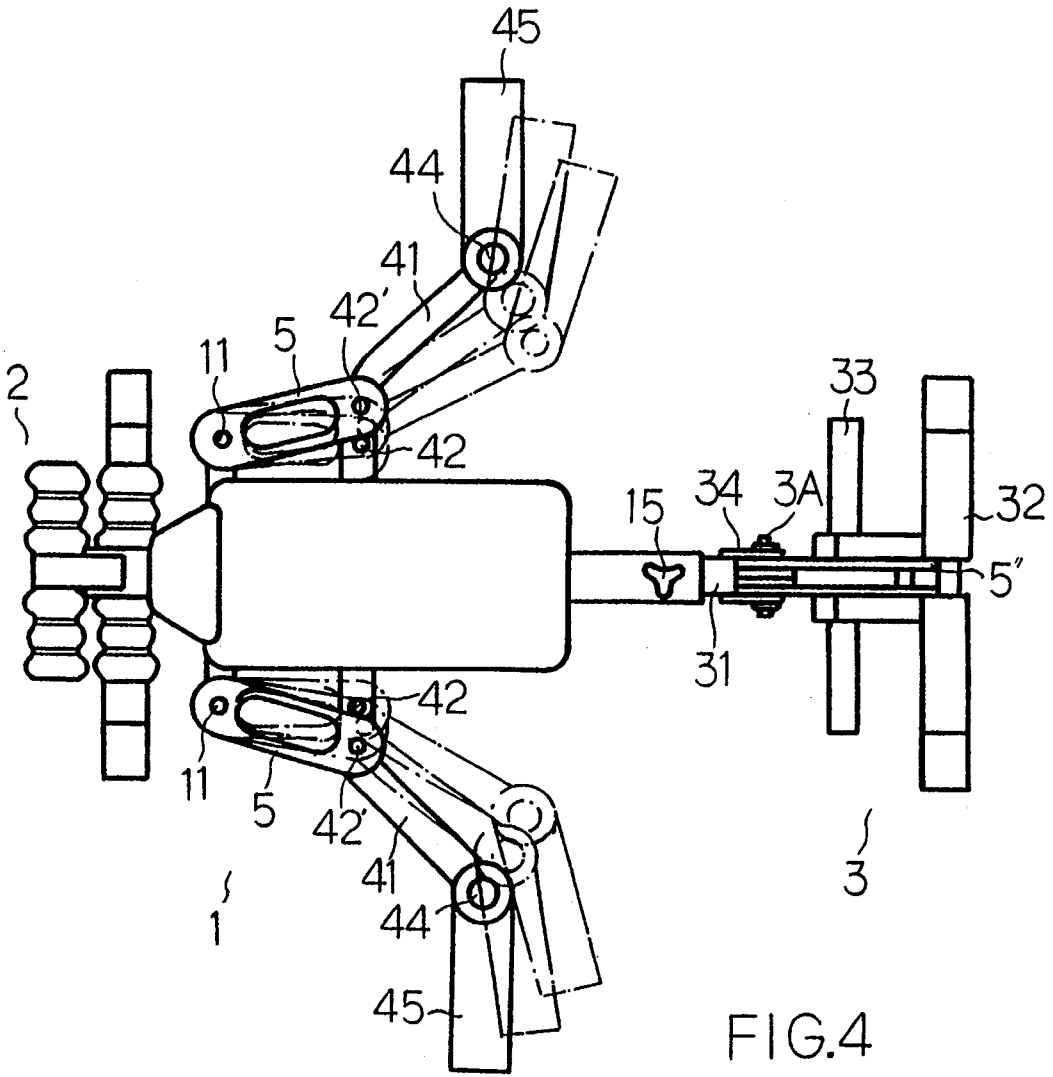
FIG. 4 is a top view of the exercising machine shown in FIG. 2, showing the scissor grip unit pushed outwards.
Figure 5:
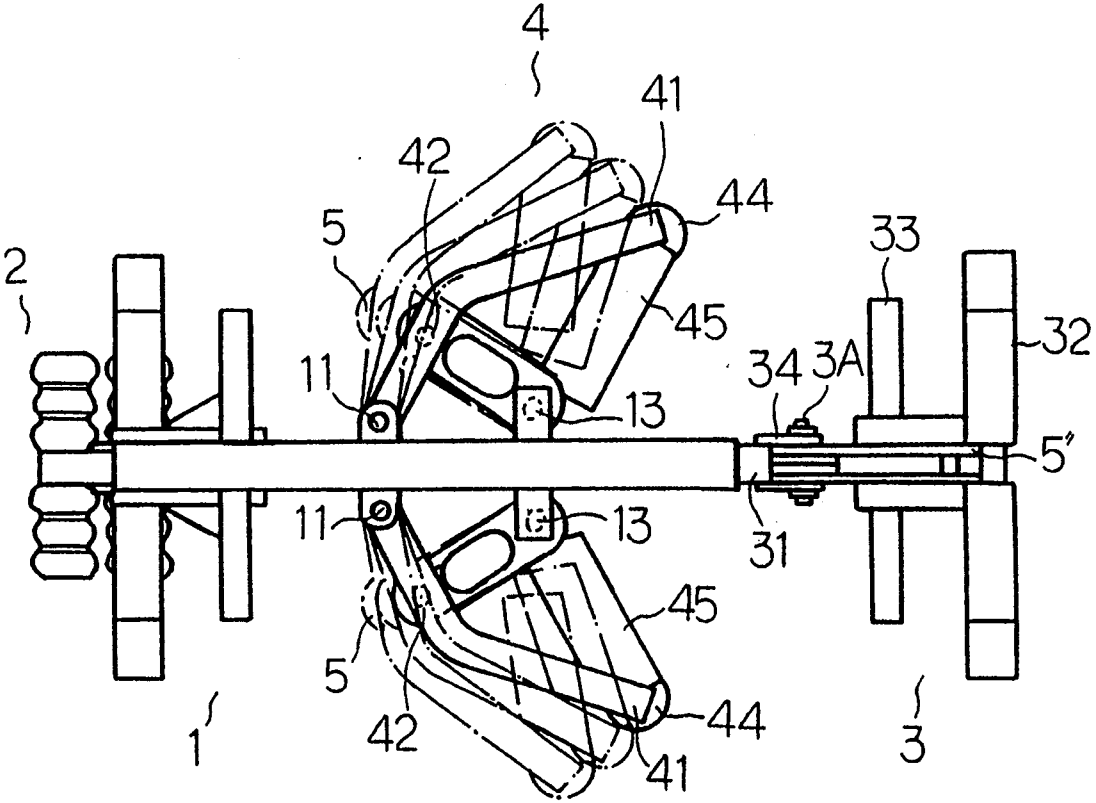
FIG. 5 is similar to FIG. 4 but showing the scissor grip unit pulled inwards.

When the first springy members 5 are connected between the first coupling rods 42′ of the pivoted lever arms 41 and the first upright rods 11, the scissor grip unit 4 produces a resistance only when the pivoted lever arms 41 are turned inwards toward each other (see FIG. 4). When the first springy members 5 are connected between the second coupling rods 42 of the pivoted lever arms 41 and the second upright rods 13, the scissor grip unit 4 Produces a resistance only when the pivoted lever arms 41 are turned outwards relative to each other (see FIG. 5).

Figure 3:
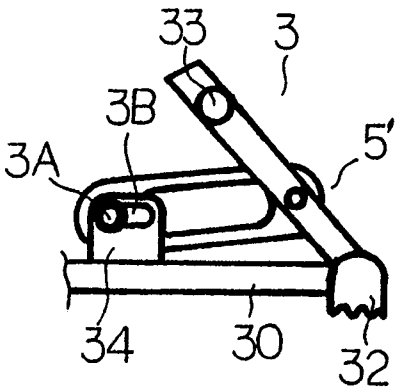
FIG. 3 is a front view of the exercising machine shown in FIG. 1, showing adjustability of the pedals.
Figure 3:
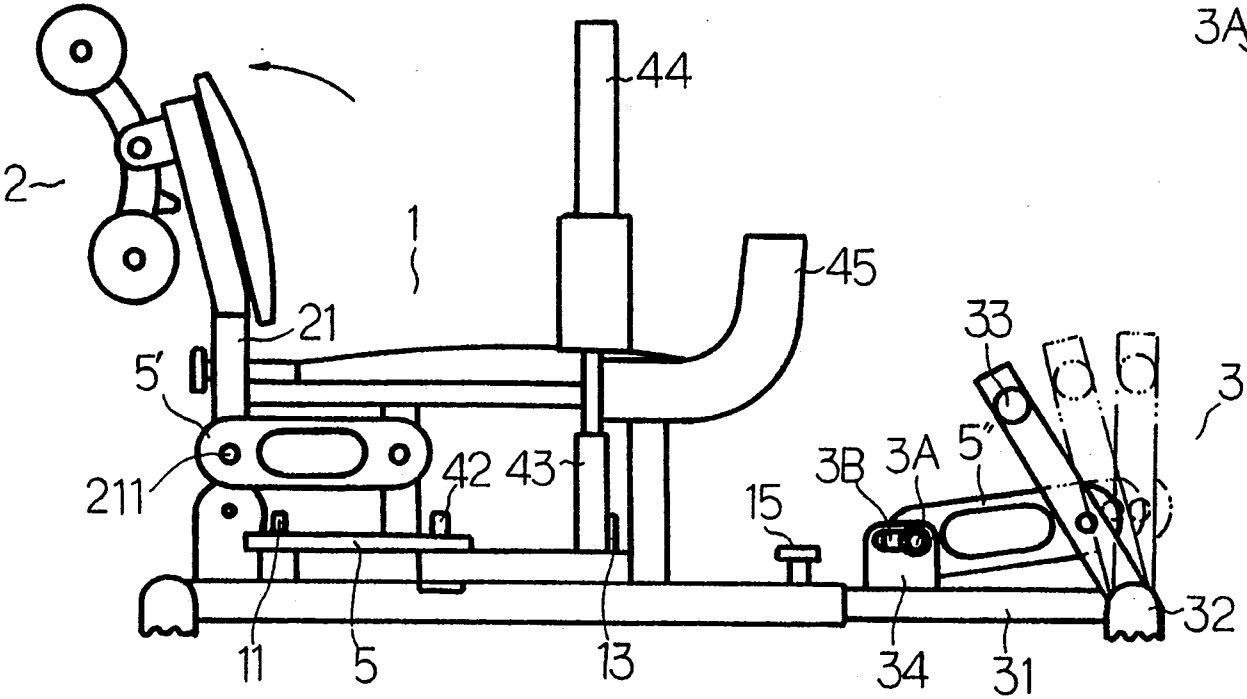

Referring to FIG. 3, the back rest 2 comprises a mounting frame 21 movably coupled to the base frame 1 and having a pair of horizontal rods 211 respectively connected to the horizontal rods 14 of the base frame 1 by a pair of second springy members 5′. The pair of second springy members 5′ produce a resistance when the back rest 2 is forced backwards.

Referring to FIG. 3 and FIG. 1 again, the leg exercising unit 3 comprises a mounting frame 30 having a longitudinal series of locating holes 31 for connection to a lock bolt 15 on the front end of the base frame 1, a front cross rod 32 perpendicularly connected to the mounting frame 30 at the front, two pedals 33 bilaterally pivotally coupled to the front cross rod 32, a pair of lugs 34 bilaterally raised from the mounting frame 30 in the middle, and a pair of third springy members 5″ connected between the pedals 33 and the lugs 34. The position of the leg exercising unit 3 on the base frame 1 can be adjusted to fit the player by loosening the lock bolt 15 from the leg exercising unit 3 and then locking it-in the desired locating hole 31. Furthermore, the lugs 34-have a respective elongated horizontal slot 3B aligned with each other for connecting the third springy members 5″ by a bolt and nut set 3A. By adjusting the position of the bolt and nut set 3A in the elongated horizontal slot 3B, the tension of the third springy members 5″ is adjusted. When the pedals 33 are pushed forward, the third springy members 5″ produce a resisting force against the legs.

What is claimed is:

1. An exercising machine comprising:

a base frame having a seat disposed at the top, a pair of first upright rods bilaterally disposed near a rear end thereof, a pair of second upright rods bilaterally disposed near a front end thereof, a bracket transversely disposed between said first upright rods and said second upright rods, a pair of horizontal rods bilaterally disposed between said first upright rods and said bracket;

a scissor grip unit having two pivoted lever arms pivotally connected to said bracket at two opposite sides and two handles respectively connected to said pivoted lever arms, said pivoted lever arms comprising each a first coupling rod and a second coupling rod spaced in the middle at the top, said handles having each a soft hand rest;

a pair of first springy members for connection between said first upright rods of said base frame and said first coupling rods of said pivoted lever arms, or alternatively between said second upright rods of said base frame and said second coupling rods of said pivoted lever arms;

a back rest having a mounting frame pivotally connected to the rear end of said base frame, the mounting frame of said back rest having a pair of horizontal rods disposed at two opposite sides; and a pair of second springy members connected between the horizontal rods of said base frame and the horizontal rods of said backrest; and wherein said scissor grip unit produces a resistance only when said pivoted lever arms are turned inwards toward each if said first springy members are connected between said first coupling rods of said pivoted lever arms and said first upright rods of said base frame; said scissor grip unit produces a resistance only when said pivoted lever arms are turned outwards relative to each other if said first springy members are connected between said second coupling rods of said pivoted lever arms and said second upright rods of said base frame.

2. The exercising machine of claim 1 further comprising a leg exercising unit connected to the front end of said base frame by a lock bolt and having two pedals pivotally bilaterally mounted on a front cross rod thereof and connected to a base frame thereof by a pair of springy members for exercising the legs.

* * * * *